US007628637B2

(12) United States Patent
Kramer

(10) Patent No.: US 7,628,637 B2
(45) Date of Patent: Dec. 8, 2009

(54) PLUG-IN CONNECTION

(75) Inventor: Anne Kramer, Berlin (DE)

(73) Assignee: ADC GmbH, Berlin (DE)

( * ) Notice: Subject to any disclaimer, the term of this patent is extended or adjusted under 35 U.S.C. 154(b) by 53 days.

(21) Appl. No.: 11/910,605

(22) PCT Filed: Mar. 1, 2006

(86) PCT No.: PCT/EP2006/001850

§ 371 (c)(1),
(2), (4) Date: Oct. 3, 2007

(87) PCT Pub. No.: WO2006/105832

PCT Pub. Date: Oct. 12, 2006

(65) Prior Publication Data

US 2008/0194133 A1 Aug. 14, 2008

(30) Foreign Application Priority Data

Apr. 4, 2005 (DE) ..... 10 2005 015 268

(51) Int. Cl.
*H01R 13/627* (2006.01)

(52) U.S. Cl. ..... 439/353

(58) Field of Classification Search ..... 439/353, 439/373, 369, 354; 385/53
See application file for complete search history.

(56) References Cited

U.S. PATENT DOCUMENTS

| | | | | |
|---|---|---|---|---|
| 5,575,677 | A | 11/1996 | Buckner et al. | |
| 6,302,721 | B1 | 10/2001 | Turner et al. | |
| 6,375,487 | B1 | 4/2002 | Tennessen | |
| 6,758,688 | B2 * | 7/2004 | Chen | 439/135 |
| 7,153,033 | B2 | 12/2006 | Kahle et al. | |
| 2003/0220004 | A1 | 11/2003 | Chen | |
| 2006/0083468 | A1 | 4/2006 | Kahle et al. | |

FOREIGN PATENT DOCUMENTS

| | | |
|---|---|---|
| CH | 685 028 | 2/1995 |
| DE | 39 03 243 A1 | 8/1990 |
| DE | 197 37 500 A1 | 3/1999 |
| DE | 100 35 383 A1 | 2/2002 |
| DE | 102 19 892 A1 | 2/2004 |
| GB | 2 303 257 | 2/1997 |
| WO | WO 02/27373 A1 | 4/2002 |

* cited by examiner

*Primary Examiner*—Phuong K Dinh
(74) *Attorney, Agent, or Firm*—Merchant & Gould P.C.

(57) ABSTRACT

The invention relates to a plug connection (1) which comprises a connector and an associated connector holder and is fastened in a front panel, with a securing element (20) being used to secure the connector against being pulled out when inserted in the connector holder, with the securing element (20) having at least one latching element (24) and at least one cover part, with the latching element (24) being used to connect the securing element (20) to the connector holder and/or the front panel in a captive manner, and with the cover part of the securing element (20) covering a grip region (13) of the connector and/or clamping the cable (15) behind the grip region (13), and to an associated securing element (20).

18 Claims, 2 Drawing Sheets

PLUG-IN CONNECTION

TECHNICAL FIELD

The invention relates to a plug connection which comprises a connector and an associated connector holder and is fastened in a front panel, and to a securing element that is suitable for it.

BACKGROUND

Various types of connectors are known in telecommunications and data technology. Examples are optical waveguide connectors, copper cable connectors or coaxial connectors for which associated matching connector holders respectively exist.

Various locking mechanisms have already been disclosed in order to prevent the connector from inadvertently being removed. By way of example, coaxial connectors are thus secured using a bayonet fitting with a ¼ turn. Three different variants of standard optical waveguide connectors having a ferrule diameter of 2.5 mm are known: the FC, the ST and the SC connector. The FC connector is screwed onto the coupling using a screw thread, for example. The ST connector has a bayonet lock, and the SC connector has a push-pull lock. Various types of SFF (Small Form Factor) connectors are also known. Examples of the latter are LC connectors, MU connectors or LX.5 connectors. Variants such as mini-duplex connectors (MT-RJ), where the connector comprises two glass fibers, also exist. These also have different locks. The mini-duplex connector and the MU connector have a push-pull lock, for example. All of these locking mechanisms protect the connector, to a greater or lesser extent, against inadvertently being removed. However, it is always possible to deliberately remove the connector. This constitutes a problem, however, in environments in which access can be controlled to only a limited extent.

SUMMARY

Therefore, the invention is based on the technical problem of providing a plug connection and a securing element that is suitable for it, which connection is used to more reliably prevent a connector from being removed and can be used to remove the connector in a manner that does not go unnoticed.

In this respect, a securing element is used to secure the connector against being pulled out when inserted in the connector holder, with the securing element having at least one latching element and at least one cover part, with the latching element being used to connect the securing element to the connector holder and/or to the front panel in a captive manner, and with the cover part of the securing element covering a grip region of the connector and/or clamping the cable behind the grip region. As a result of the securing element being connected to the front panel and/or to the connector holder in a captive manner, the securing element has to be destroyed in order to be removed. This in turn makes it possible to visually check, in a rapid and simple manner, whether someone has tampered with the connector in an unauthorized manner. Although authorized service personnel also have to destroy the securing element, they can then fit a new securing element again after handling. The basic principle of the securing element is that, if the grip region of most connectors is not accessible, it cannot be pulled. This applies equally to push-pull, bayonet, screw and latching connections. Alternatively or in addition, the cable of the connector can be clamped behind the grip region. This results in the connector being fixed, at the front, by the latching element of the securing element and, at the back, by the clamping. This variant is preferably used in connectors which could otherwise also be removed from the connector holder by pulling on the cable. One advantage over conceivable key-operated locks is the simple and cost-effective implementation. Appropriate color markings also make it possible to sell the same securing elements to different customers, with the different colors making it possible to restrict misuse as a result of unauthorized passing on to third parties.

In one preferred embodiment, the securing element has a cutout, so that the securing element can be pushed onto the connector that has been inserted. Subsequent securing can thus be carried out without having to pull the connector.

In another preferred embodiment, the connector is in the form of an optical waveguide connector and the connector holder is in the form of a coupling or adapter, with a coupling being formed for the purpose of accommodating identical connectors, and an adapter being formed for the purpose of accommodating two connectors of different types. In this case, it should be noted, in addition, that, sometimes in usage, the coupling is also even referred to as an adapter and the adapters are referred to as hybrid adapters. The coupling or the adapter is fastened in the front panel using a front clip. The front clip can be used to unlock the coupling or the adapter from the front side. To this end, the front clip is preferably in two parts. As regards one preferred refinement of the front clip, reference is made to WO 02/27373 A1, to whose disclosure reference is hereby expressly made. The latching element for the securing element is then latched into an opening in the front clip, with an additional blocking element for the securing element preventing the front clip from being removed.

In another preferred embodiment, the connector is in the form of an SC or MU connector having a push-pull lock.

In another preferred embodiment, the connector holder is in the form of a coupling or an adapter onto which a laser shutter (which can be retrofitted) is plugged, with the cover part completely covering the grip region of the connector in the longitudinal direction. In other words, the securing element is preferably dimensioned in such a manner that, even when the laser shutter is used, this ensures that the grip region is completely covered. Such a laser shutter (which can be retrofitted) is disclosed, for example, in DE 102 19 892 A1 to which reference is expressly made as regards the design of the laser shutter.

BRIEF DESCRIPTION OF THE FIGURES

The invention will be explained in more detail below using one preferred exemplary embodiment. In the figures.

DETAILED DESCRIPTION

Figure 1:
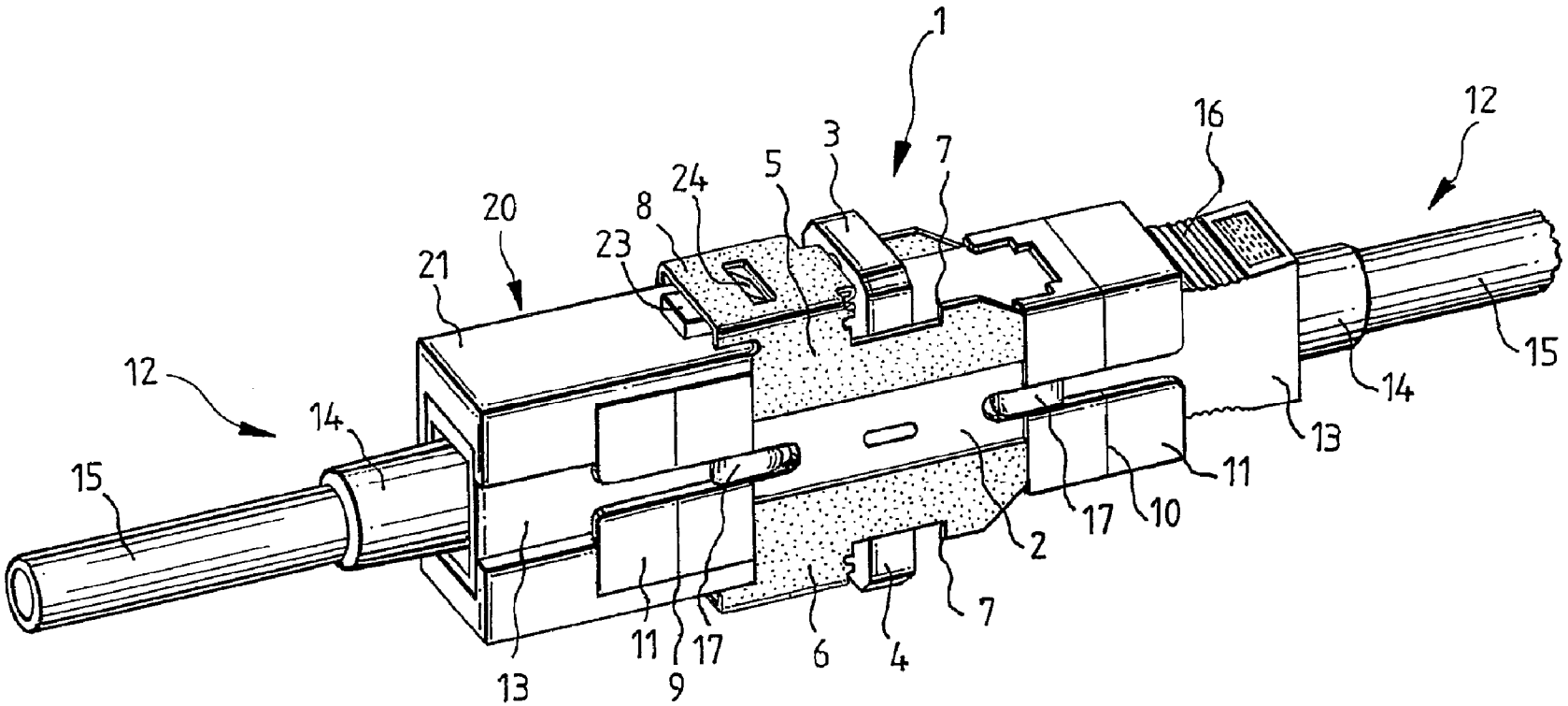
FIG. 1 shows a plug connection of an SC connector having a coupling.
Figure 2:
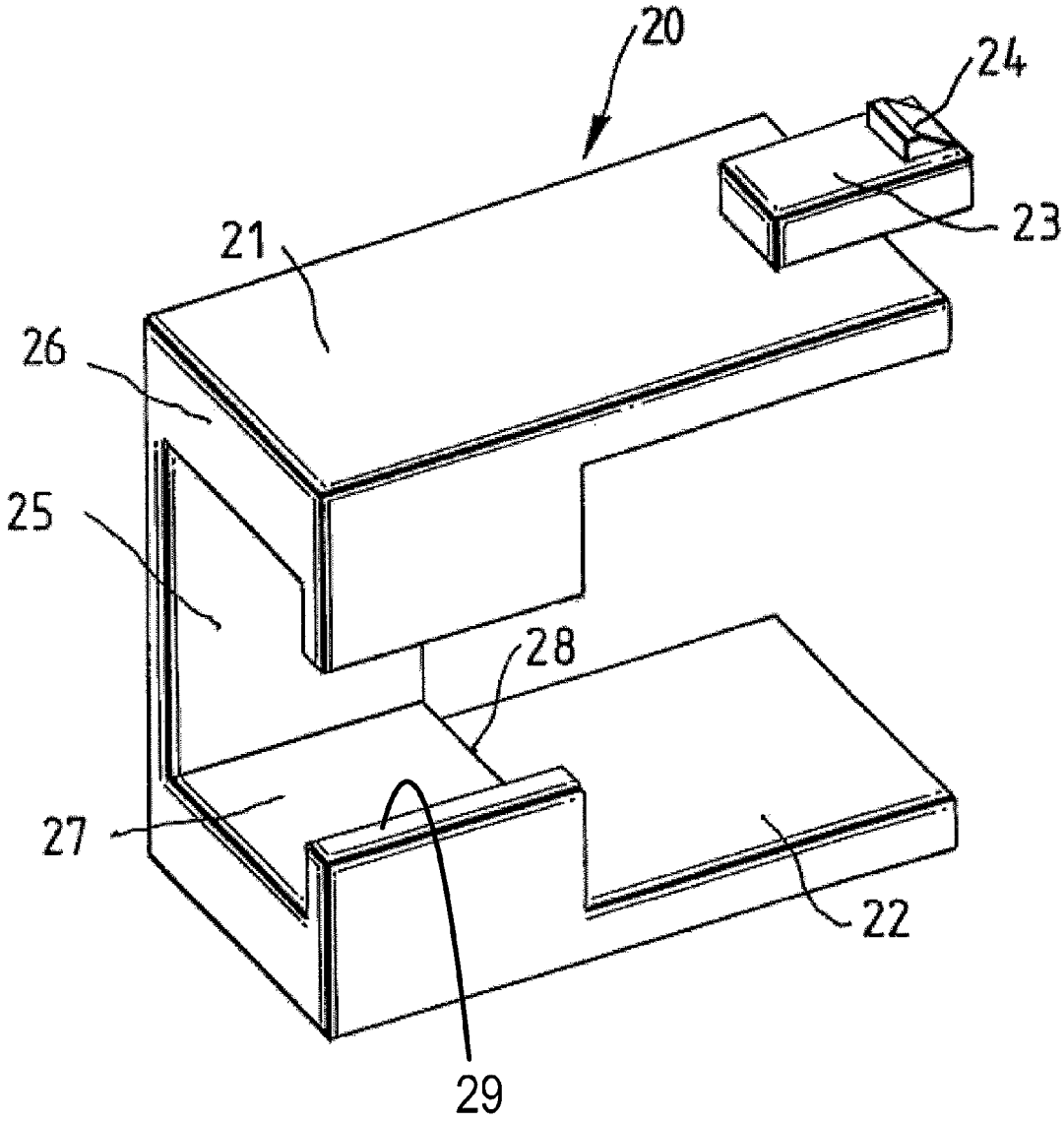
FIG. 2 shows a perspective illustration of a securing element.

FIG. 1 shows a perspective illustration of a plug connection 1 having a coupling 2. On the upper and lower faces, the coupling 2 has a respective flange 3, 4, by means of which the coupling 2 strikes against a front panel (not illustrated). In order to fasten the coupling to, and remove it from, the front panel, the coupling 2 has a two-part front clip 5, 6. This front clip 5, 6 is designed in such a manner that it uses latching hooks 7 to hook in behind the front panel and thus fasten the coupling. Pressing the areas 8 (which are on the upper and lower faces of the coupling 2) together unlocks the front clip 5, 6 and thus the associated coupling 2. Attachments 11 comprising a laser shutter are also latched onto the front sides 9, 10 of the coupling 2. The attachments 11 can thus be used to subsequently form a coupling 2 having a laser shutter in a simple manner. A first SC connector 12 is inserted from the rear side of the coupling 2. The SC connector 12 comprises a grip region 13, kink protection 14 and the glass fiber cable 15. In order to pull the SC connector 12, the connector must be held at the grip region 13, that is to say the SC connector 12 cannot be removed by merely pulling on the kink protection 14 or on the glass fiber cable 15. To this end, the SC connector 12 is usually gripped and pulled on the grooved upper face 16 and lower face. However, it is also possible to hold and pull the SC connector 12 on the side surfaces. When inserted, a guide web 17, which is arranged on each of the side surfaces, is located in the slots (which are open to the outside) in the coupling 2. An SC connector 12, which, however, is secured using a securing element 20 (which is illustrated on its own in FIG. 2), is likewise inserted from the front face of the coupling 2.

The securing element 20 has a planar rectangular upper face 21 and lower face 22. A cuboidal blocking element 23, on which a latching element 24 is located, is arranged on the upper face 21. The upper and lower faces 21, 22 are connected to one another via a side wall 25, whereas the other side has a cutout 29. The end face 26 (which is opposite the latching element 24) of the securing element 20 also has thickened regions 27, so that a stop edge 28 is formed at the end of the thickened regions 27.

As can now be seen in FIG. 1, the latching element 24 latches into an opening in the front clip 5, with the blocking element 23 preventing the area 8 from being pressed down. It can also be seen that the upper face 21 and lower face 22 of the securing element 20 completely cover the grooved upper face 16 and lower face. The side wall 25 also covers the protruding part of one side surface of the SC connector 12. As a result, the SC connector 12 can no longer be pulled without destroying the securing element 20. The latter must then be pulled with great force until the latching element 24 shears off at the front clip 5. In this case, the securing element 20 (which is preferably integral) is preferably made of plastic. In the exemplary embodiment illustrated in FIGS. 1 and 2, the upper face 21, lower face 22 and side wall 25 form the cover part of the securing element 20.

List of Reference Symbols

1 Plug connection
2 Coupling
3 Flange
4 Flange
5 Front clip
6 Front clip
7 Latching hook
8 Areas
9 Front face
10 Front face
11 Attachments
12 SC connector
13 Grip region of the SC connector
14 Kink protection
15 Glass fiber cable
16 Grooved upper face
17 Guide web
20 Securing element
21 Planar rectangular upper face
22 Planar rectangular lower face
23 Cuboidal blocking element
24 Latching element
25 Side wall
26 End face
27 Thickened regions
28 Stop edge
29 Cutout

The invention claimed is:

1. A plug connection which is configured to fasten to a front panel, the plug connection comprising:

a connector defining a grip region and being associated with an optical fiber;

an associated connector holder, the connector holder including a front clip configured to fasten the connector holder to the front panel; and a securing element configured to secure the connector against being pulled out when inserted in the connector holder, the securing element having at least one latching element, a blocking element, and at least one cover part, the latching element being configured to connect the securing element to the front clip of the connector holder in a captive manner, and the cover part of the securing element covering the grip region of the connector and clamping a cable behind the grip region, the blocking element of the securing element preventing the front clip from being removed from the front panel.

2. The plug connection as claimed in claim 1, wherein the securing element has a cutout, so that the securing element can be pushed onto the connector that has been inserted.

3. The plug connection as claimed in claim 1, wherein the connector is in the form of an optical waveguide connector and the connector holder is in the form of a coupling or adapter.

4. The plug connection as claimed in claim 1, wherein the connector is in the form of an SC connector or MU connector.

5. The plug connection as claimed in claim 1, wherein the connector holder is in the form of a coupling or an adapter onto which a laser shutter is plugged, with the cover part completely covering the grip region of the connector in the longitudinal direction.

6. A plug connection system comprising:

a connector holder;

a clip mounted to the connector holder, the clip including a pressing region that defines an opening, the clip being configured to move from a locking position to an unlocking position when the pressing region is depressed;

at least a first optical connector configured to be plugged into the connector holder, the first optical connector including a grip region; and a securing element configured to mount to the first optical connector, the securing element including a body and a latching element, the body being configured to cover the grip region of the first optical connector, and the latching element being configured to engage the opening defined by the pressing region of the clip.

7. The plug connection system of claim 6, wherein the body of the securing element includes parallel side walls extending between upper and lower parallel faces.

8. The plug connection system of claim 7, wherein one of the side walls defines a cutout configured to enable the securing element to mount to the first optical connector without unplugging the first optical connector from the connector holder.

9. The plug connection system of claim 7, wherein the body of the securing element further includes an end wall extending between the upper and lower parallel faces and the parallel side walls, the end wall being configured to clamp the first optical connector to the connector holder when the first optical connector is inserted into the connector holder.

10. The plug connection system of claim 9, wherein the securing element includes a thickened region at the end wall, the thickened region forming a stop edge against which the first optical connector abuts when the securing element is mounted to the first optical connector and the latching element of the securing element is engaged with the opening of the clip.

11. The plug connection system of claim 6, wherein the securing element further comprises a blocking element that is configured to be arranged between the connector holder and the pressing region of the clip to inhibit depression of the pressing region.

12. The plug connection system of claim 6, wherein the connector is in the form of an SC connector or MU connector.

13. The plug connection system of claim 6, further comprising a laser shutter mounted to the connector holder.

14. The plug connection system of claim 6, wherein the securing element is configured to hold the first optical connector to the connector holder until a force sufficient to shear the latching element off the securing element is applied to the first optical connector.

15. A method for securing a connector to a connector holder, the method comprising:

providing a connector holder including a front clip having a latching hook that is configured to latch to a front panel;

pushing a securing element onto an optical connector so that a body of the securing element covers a grip region of the optical connector;

latching the securing element to the front clip of the connector holder; and latching the connector holder and the optical connector to the front panel with the front clip.

16. The method of claim 15, further comprising inserting the optical connector into the connector holder prior to pushing the securing element onto the optical connector.

17. The method of claim 15, wherein latching the securing element to the front clip comprises:

sliding a latching element on the securing element into an opening defined in the front clip; and sliding a blocking element on the securing element beneath the front clip on the connector holder.

18. The method of claim 15, further comprising applying a force sufficient to shear off latching elements of the securing element to remove the optical connector and the securing element from the connector holder.

* * * * *